US012691347B2

(12) United States Patent
Alfonso

(10) Patent No.: US 12,691,347 B2
(45) Date of Patent: Jul. 28, 2026

(54) NET HOLDER AND DEVICE FOR MOUNTING THE NET HOLDER

(71) Applicant: Alexander Alfonso, Berlin (DE)

(72) Inventor: Alexander Alfonso, Berlin (DE)

( * ) Notice: Subject to any disclaimer, the term of this patent is extended or adjusted under 35 U.S.C. 154(b) by 779 days.

(21) Appl. No.: 17/960,566

(22) Filed: Oct. 5, 2022

(65) Prior Publication Data

US 2023/0107165 A1 Apr. 6, 2023

(30) Foreign Application Priority Data

Oct. 5, 2021 (EP) ..... 21200914

(51) Int. Cl.
*A63B 63/08* (2006.01)

(52) U.S. Cl.
CPC ..... *A63B 63/083* (2013.01); *A63B 2209/02* (2013.01)

(58) Field of Classification Search
CPC ..... A63B 63/083
USPC ..... 473/488, 485, 487, 489
See application file for complete search history.

(56) References Cited

U.S. PATENT DOCUMENTS 1,157,333 A * 10/1915 Snell ..... F16M 11/10 248/315
1,904,836 A * 4/1933 Peoples ..... A63B 63/083 473/448
2,708,576 A * 5/1955 Verkuilen ..... A63B 63/083 473/448
2,783,573 A 3/1957 Rau et al.
2,918,283 A * 12/1959 Marschalk ..... A63B 63/083 473/448
3,348,840 A * 10/1967 Dix ..... A63B 63/083 473/449
3,595,573 A 7/1971 Kilbourne
4,261,185 A * 4/1981 Martinez ..... A44C 9/02 63/15.6
4,903,964 A * 2/1990 Anderson ..... A63B 63/083 473/489
5,098,091 A * 3/1992 McGivern ..... A63B 63/083 473/489
5,364,092 A * 11/1994 Riepe ..... A63B 63/083 473/448
6,440,014 B1 * 8/2002 Checko ..... A63B 63/083 473/485

(Continued)

FOREIGN PATENT DOCUMENTS

CN 111544869 A 8/2020
DE 102016008550 A1 1/2017

(Continued)

*Primary Examiner* — Essama Omgba
(74) *Attorney, Agent, or Firm* — Wood, Phillips, Katz, Clark & Mortimer

(57) ABSTRACT

A net holder for a basketball net, comprising a closed hoop, a net, an insert ring open in one portion arranged circumferentially in the hoop, wherein the insert ring can be inserted in the inner circumference of the hoop, wherein the open portion of the insert ring is angled with its ends so that two pins oriented in the same direction from the plane of the insert ring protrude from same and are connected in turn to one another by a crosspiece with a fixed and a releasable bearing for the pins, wherein a snap lock is arranged in the region of the releasable bearing for the pin and can be latched into the crosspiece by using a tappet to block the releasable bearing.

15 Claims, 3 Drawing Sheets

(56) References Cited

U.S. PATENT DOCUMENTS

| | | | | |
|---|---|---|---|---|
| 6,672,105 | B1 * | 1/2004 | Sills | A44C 9/02 63/15.5 |
| 7,229,367 | B2 * | 6/2007 | Baker | A63B 69/0071 473/448 |
| D997,765 | S * | 9/2023 | Läubli | D11/26 |
| 2004/0043841 | A1 * | 3/2004 | Williams | A63B 69/0071 473/448 |
| 2005/0176527 | A1 * | 8/2005 | Zuccarini | A63B 69/0071 473/448 |
| 2006/0035735 | A1 * | 2/2006 | Baker | A63B 69/0071 473/448 |
| 2008/0076608 | A1 * | 3/2008 | Hill | A63B 63/083 473/488 |
| 2008/0300073 | A1 * | 12/2008 | Krueger | A63B 63/083 473/448 |
| 2010/0083701 | A1 * | 4/2010 | Huynh | A44C 9/02 63/15.5 |
| 2013/0040765 | A1 * | 2/2013 | Myles | A63B 69/0071 473/447 |
| 2017/0239542 | A1 * | 8/2017 | Seto | A63B 63/083 |
| 2023/0107165 | A1 * | 4/2023 | Alfonso | A63B 71/0036 473/485 |

FOREIGN PATENT DOCUMENTS

| | | | | |
|---|---|---|---|---|
| GB | 623926 | * | 5/1949 | F16L 29/00 |
| WO | WO-2018201172 | A1 * | 11/2018 | F41A 21/487 |
| WO | WO-2023161014 | A1 * | 8/2023 | A44C 9/02 |

* cited by examiner

NET HOLDER AND DEVICE FOR MOUNTING THE NET HOLDER

FIELD OF THE INVENTION

The invention relates to a net holder for a basketball net and to a device for mounting the net holder on an existing hoop.

BACKGROUND OF THE INVENTION

In order to remove basketball baskets or exchange the net of basketball baskets, a ladder is required because the basketball baskets are arranged at a height of over 3 meters. These ladders are generally not available on playgrounds, in particular for mass sport. This leads to the fact that play takes place without a net in this case, with the result that a ball thrown through the hoop bounces out in an uncontrolled manner so as to only have to be fetched again.

DE 298 18 710 U1 therefore proposes releasably arranging the basketball basket in an anchor which is accessible from above and providing the basketball basket with a threaded sleeve which is accessible from below.

A threaded rod is screwed into the threaded sleeve by a person standing on the ground and is released from the anchor and inserted into the anchor by said person, respectively, pushing up or letting down the basketball hoop. It is disadvantageous that the basketball basket always has to be moved with the holder and also has to be accommodated after the removal.

Another way is introduced by DE 10 2016 008 550 A1. In the case of a net holder having a hoop, wherein the hoop has hooks for fastening a net which are distributed on a circumferential line and over the circumference, it is proposed that it be possible to at least reduce the circumference of the hoop by hand or by means of a device in a manner building up a spring tension so that the hoop can be inserted in a receptacle and there is at least one clamping connection with the receptacle when the spring tension is reduced as a result of a widening. In order for this net holder to function, the hoop must have a cross-sectional opening which can be closed again in a suitable manner during mounting. This leads to instability of the hoop or is technically complex, so broad application is precluded.

BRIEF SUMMARY OF THE INVENTION

The object of the invention is to design a net holder in such a way that net mounting and/or dismounting is possible while maintaining the stability of the net holder, which is provided by the closed hoop, and to provide a device for the arrangement of the net holder preferably by a person standing on the ground.

The object is achieved with the features of claim 1. A corresponding handling device is proposed in claim 13. Advantageous embodiments are the subject matter of the dependent claims.

The present invention is linked to the concept of using an insert ring with a net as an insert in an existing basketball hoop with a worn or missing net, wherein the insert ring is prepared by a person on the ground, then transported by means of a rod to the height of the basket and fixed there.

If the rod is a telescopic rod, it can easily be transported to the court, since the transport length can be shortened. The insert ring together with the net can be transported conveniently in a bag, preferably rounded or even two-dimensionally round. A label is located on the bag.

In this case, the net change including the insert ring can be carried out for every game or every training session as well as for a longer duration.

Two variants are provided:

In the first variant, both the hoop and the insert ring have a circular or oval cross section, wherein the connection is secured by clamps, and in the second variant the insert ring is introduced into a hoop having a C-shaped cross section.

By using light materials for the insert rings which should have spring properties, the proposed technical solution is still more attractive. Such materials may be, for example, aluminum or fiber-reinforced plastics. Of course, it is also possible to use steel or another metal.

According to the invention, in the case of a net holder for a basketball net comprising a closed hoop and a net, by means of which a ball that has passed through the hoop is braked and directed towards the ground, an insert ring which is open in one portion is arranged in the hoop in that the circumference of the insert ring can be made smaller in a manner building up a tension so that it can be inserted into the inner circumference of the hoop and, upon release of the tension, bears against the inner walls of the hoop, and it is proposed that the open portion of the insert ring be angled with its ends so that two pins oriented in the same direction from the plane of the insert ring protrude from same and are connected in turn to one another by a crosspiece with a fixed and a releasable engagement, and the circumferential change in the insert ring is achieved by a movement of the pins towards one another and away from one another.

Due to the combination of open portion, bent-out pins, crosspiece with fixed engagement on one side and a releasable engagement on the other side, the insert ring receives a high level of dimensional stability despite the open portion.

There is an interlocking and/or frictional connection between the hoop and the inserted insert ring. This ensures that the complexly shaped hooks used in conventional net holders for the basketball net—bent twice laterally and crimped towards the hoop—can be dispensed with. Instead, simple hooks can be used on the insert ring, since advantage is still taken of the interlocking and/or frictional connection component, which leads to a clamping of the net.

In the case of an annular insert ring in cross section, the insert ring preferably has clamps which are distributed on the circumference and which, when the insert ring bears against the hoop, partially encompass the latter.

In the other embodiment, the cross section of the hoop is a C-shaped cross section which points with its opening in the direction of the insert ring.

It is thus possible to select between two embodiments in the case of retrofits and new installations, wherein, in the case of new installations of the C-shaped variant, preference is given to there being smooth transitions and no possibly interfering clamps.

The insert ring consists of a resilient material, in particular aluminum or a fiber-reinforced plastic or steel.

The angle of the pins with respect to the plane of the insert ring is preferably 90°+−15%.

In the case of an advantageous embodiment, a snap lock is arranged in the region of the releasable engagement for a pin and latches into the crosspiece by means of a tappet and then blocks the releasable engagement. This snap lock significantly increases the dimensional stability of the insert ring, since it prevents movements of the pins or of the insert ring.

The pins and/or widened portions arranged on the pins preferably consist of a solid material and form the engagement points for the releasable and the fixed engagement. The widened portions thus create more space 30 for the engagements. The pins can also be widened by a shaping procedure in the technological process.

In an advantageous embodiment, the snap lock has a tappet which can be displaced longitudinally in a bushing connected to a pin and/or a widened portion on the pin and which can be moved out of the blocking function against the force of a spring and thus, on the one hand, enables the clamping connection between the hoop and the insert ring and, on the other hand, makes it possible to reduce the diameter of the insert ring. In this case, the bushing should be arranged in such a way that the tappet is guided past the crosspiece. As a result, the tappet can engage from above in the crosspiece and engage the gear mechanism from below in order to adjust the pins.

A prerequisite for this is that the tappet is double-angled at one end, the last angled portion engaging in an opening of the crosspiece for blocking the releasable engagement.

In the device for mounting the net holder, a mounting device can be placed on the pins, which mounting device has a rod of sufficient length and buckling strength and at the end of which a gear mechanism is disposed. The gear mechanism is actuated by means of a Bowden cable. In a first step, when the gear mechanism is placed on the pins, the tappet is released from the blocking position: hence the above-mentioned guidance past the crosspiece. In a second step, the pins are moved towards one another, wherein the reduction in the circumference of the insert ring is so great that it can be conveniently inserted into the hoop. In a third step, the insert ring is expanded again and bears against the hoop, including the basketball net.

When the gear mechanism is removed, the tappet latches in the crosspiece and blocks the loose engagement.

A possible gear mechanism for displacing two pins relative to one another is explained in the exemplary embodiment, without the invention being restricted to this embodiment.

BRIEF DESCRIPTION OF THE DRAWINGS

The invention is explained with reference to the drawings. In the drawings.

DETAILED DESCRIPTION OF THE INVENTION

Figure 1:
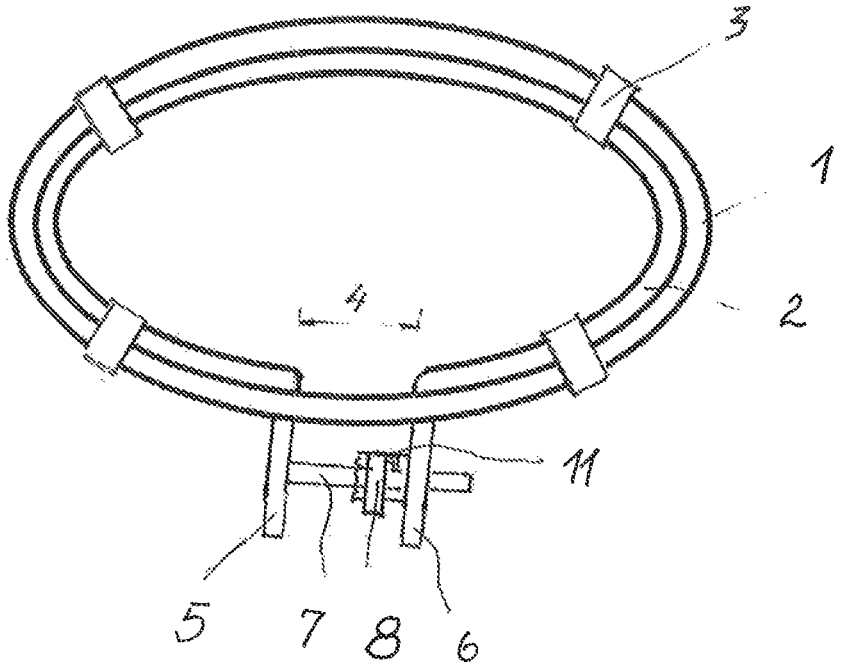
FIG. 1 shows an embodiment with full and partial views for existing basketball baskets.
Figure 1:
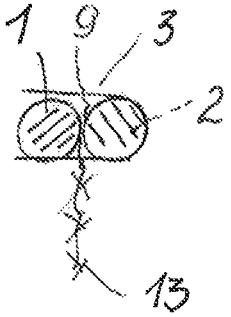
Figure 1:
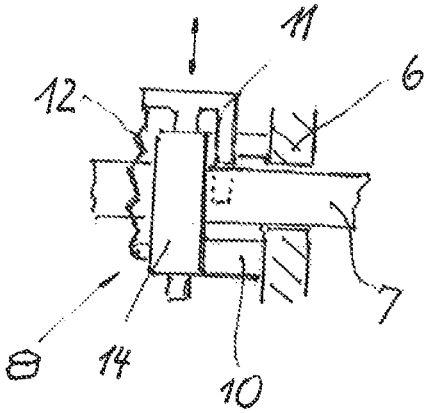

FIG. 1 shows a net holder for a basketball net 13 having a closed hoop 1 and a net, through which a ball that has passed through the hoop 1 is braked and directed toward the ground. This net holder is one used everywhere. Replacing the net requires a ladder because the net holder is permanently installed at a lofty height.

Figure 3:
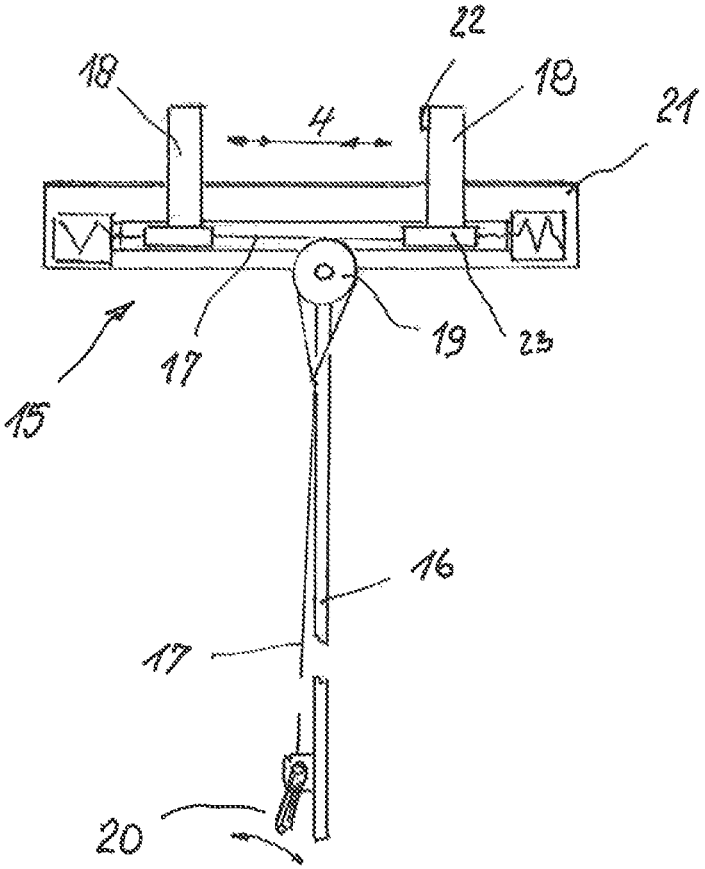
FIG. 3 shows a gear mechanism for tensioning and releasing the insert ring.

According to the invention, in this embodiment, an insert ring 2 which is open in one portion 4 is arranged circumferentially in the hoop 1 in that the circumference of the insert ring 2 is reduced in a manner building up a tension so that it can be inserted in the inner circumference of the hoop 1 and, when the tension is released, bears against the inner walls of the hoop 1. In order to achieve this from the ground, the open portion 4 of the insert ring 2 is angled with its ends so that two pins 5, 6 oriented in the same direction from the plane of the insert ring 2 protrude from same and are connected in turn to one another by a crosspiece 7 with a fixed and a releasable engagement for the pins 5, 6, and the circumferential change in the insert ring 2 can be achieved by a movement of the pins 5, 6 towards one another and away from one another. Now only one device is needed to move the pins accordingly and thus the insert ring 2. One such device is shown in FIG. 3.

Due to the combination of the pins 5, 6 with the crosspiece 7 and the loose and the fixed engagement of the crosspiece 7 with the pins 5, 6, the net holder has a high level of dimensional stability.

The fixing of the insert ring 2 to the hoop 1 is improved by virtue of the fact that the insert ring 2 has clamps 3 which are distributed on the circumference 20 and which, when the insert ring 2 bears against the hoop 1, partially encompass the latter.

According to a further advantageous embodiment, a snap lock 8 is arranged in the region of the releasable engagement for the pin 6 and can be latched into the crosspiece 7 by means of a tappet 11 and then blocks the releasable engagement. The snap lock 8 preferably has a tappet 11 which can be displaced longitudinally in a bushing 14 connected to the pin 6 and/or the rod portion 10 and which can be moved out of the blocking function against the force of a spring 12 and thus, on the one hand, enables the clamping connection between the hoop 1 and the insert ring 2 and, on the other hand, makes it possible to reduce the diameter of the insert ring 2.

The bushing 14 is arranged in such a way that the tappet 11 is guided past the crosspiece 7.

So that it can then engage in the crosspiece 7, the tappet 11 is double-angled at one end, the last angled portion engaging in the opening of the crosspiece 7 during the blocking of the releasable engagement.

This arrangement is advantageous in order to prevent collisions between the gear mechanism 15 and the tappet 11 in the device for attaching the insert ring 2.

Figure 2:
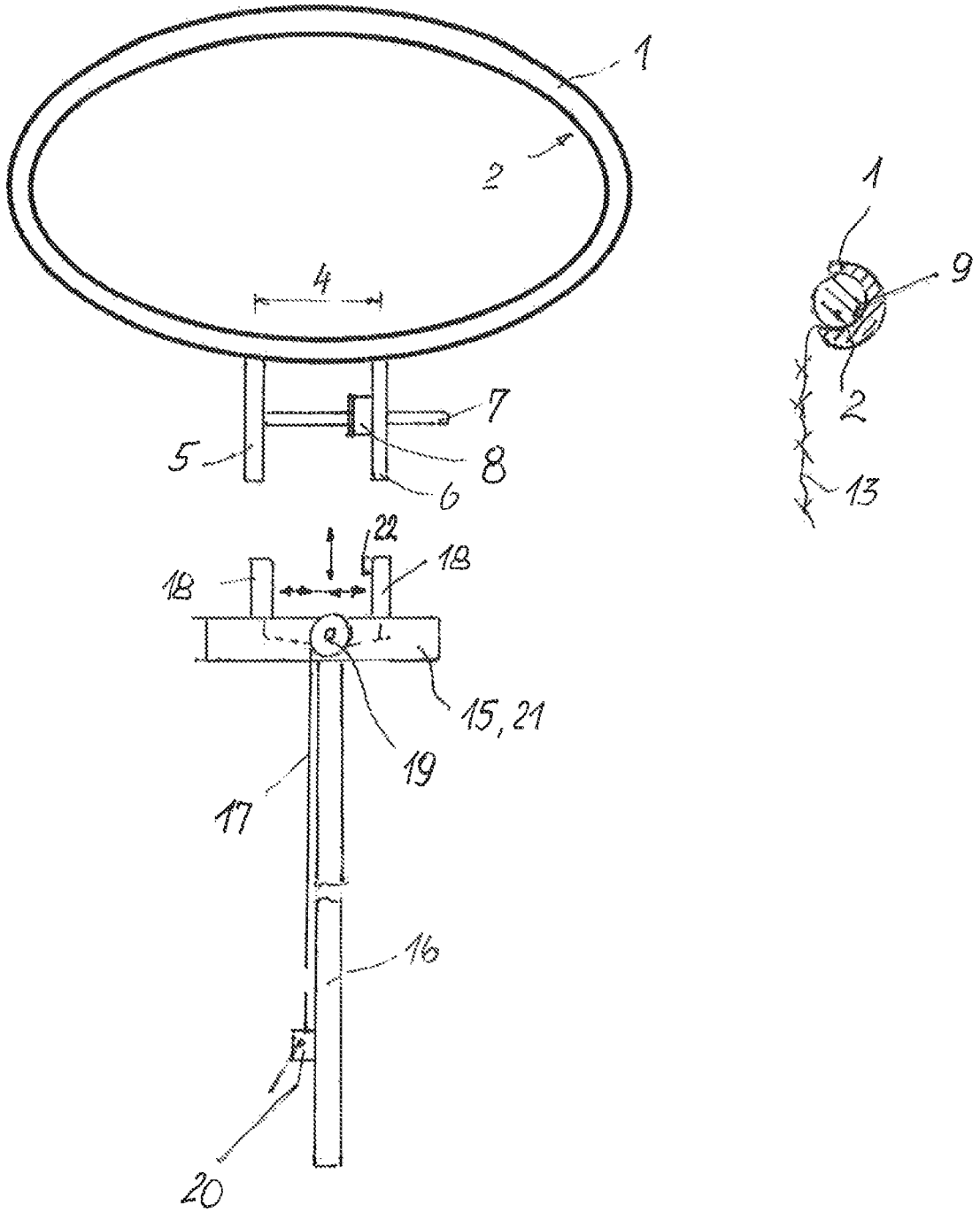
FIG. 2 shows a preferred embodiment with an insertable insert ring in a C-profile.

The net holder according to FIG. 2 differs from that described above in that the hoop 1 has a C-shaped cross section pointing with the opening in the direction of the insert ring 2. This variant can be used in particular in new installations, since it has a number of advantages.

The complicated hooks 9 for suspending the net in conventional suspension means can be dispensed with and replaced by simple hooks. This makes the interlocking and/or frictional connection possible between the hoop 1 and the inserted insert ring 2.

Clamps 3, which are additionally to be attached, are dispensed with. There are smooth transitions between the hoop 1 and the insert ring 2.

The material requirement is reduced by almost 50%.

FIG. 2 also shows the device for attaching and removing the net holder, which is discussed in more detail in FIG. 3. The present illustration shows the connection of the net holder via the receptacles 18 for the pins 5, 6. The receptacle 18 for the pin 6 has a stop 22 at the top which acts on the tappet 11 against the spring force of the spring 12 and pushes the tappet 11 out of the blocking position for the releasable engagement. The diameter of the insert ring 2 can now be reduced by moving the receptacles 18 for the pins 5, 6 towards one another.

In both embodiments, the insert ring 2 consists of a resilient material, in particular aluminum or a fiber-reinforced plastic or steel. In these embodiments, the diameter of the insert ring is selected in each case in such a way that the increase in diameter between the hoop 1 and the inserted insert ring 2 leads to an interlocking and/or frictional connection.

FIG. 3 shows a mounting device which is placed on the pins 5, 6 by means of the receptacles 18, which has a rod 16 of sufficient length and buckling strength, at the end of which there is a gear mechanism 15 for moving the receptacles 18 and which has a Bowden cable 17 for actuating the gear mechanism 15. The Bowden cable 17 is actuated by means of a ratchet 20.

The gear mechanism 15 has a guide rail 21 for the receptacles 18 for the pins. The receptacles 18 for the pins 5, 6 are displaced in a spring-loaded manner in the guide rail 21, for which purpose a sliding block 22 is arranged for each receptacle 18 in the guide rail 21. The sliding blocks 22 are connected to the respective Bowden cables 17, wherein the two Bowden cables 17 are deflected via deflection rollers 19 arranged centrally in relation to the guide rail 21 into an almost parallel course to the rod 16. Advantageously, the two Bowden cables are then combined and can thus be tensioned as one Bowden cable 17 by the ratchet 20 in order to move the pins 5, 6 towards one another.

When the insert ring 2 has reached the optimum position, the ratchet 20 is released and the insert ring assumes its position on or in the hoop 1.

Removal of the insert ring 2 is performed in an analogous manner.

LIST OF REFERENCE SIGNS

1 Hoop closed
2 Insert ring open
3 Clamps
4 Open portion of the insert ring
5 Pin
6 Pin with snap lock
7 Crosspiece
8 Snap lock
9 Hook
10 Widened portion of the pins
11 Tappet
12 Spring
13 Basketball net
14 Bushing
15 Gear mechanism
16 Rod
17 Bowden cable
18 Receptacle for pin
19 Deflection roller
20 Ratchet
21 Guide rail
22 Stop
23 Sliding block

What is claimed is:

1. A net holder for a basketball net comprising:

a closed hoop and a net, the hoop including an inner wall with an inner circumference, the net configured to brake a ball that has passed through the hoop and direct the ball to the ground;

an insert ring comprising an outer circumference and an opening in one portion, the insert ring arranged circumferentially inside the hoop, the outer circumference of the insert ring configured to be made smaller and build up tension so that the insert ring can be inserted in the inner circumference of the hoop and after the tension is released, bear against the inner wall of the hoop, the insert ring defining a plane;

wherein;

the open portion of the insert ring comprises two opposite pins that are angled perpendicularly and protrude in a direction of a plane that is perpendicular to the plane of the insert ring, the pins spaced apart and connected to each other by a crosspiece having a fixed engagement and a releasable engagement on the pins, and wherein movement of the pins towards and away from one another changes the circumference of the ring;

a snap lock arranged in a region of the releasable engagement on one of the pins, the snap lock configured to be latched into the crosspiece using a tappet to block the releasable engagement.

2. The net holder according to claim 1, wherein the net holder further comprises an interlocking and/or frictional connection between the hoop and the inserted insert ring.

3. The net holder according to claim 1, wherein the hoop comprises an annular or a C-shaped cross section.

4. The net holder according to claim 1, wherein the insert ring comprises clamps which are distributed on the outer circumference and which, when the insert ring bears against the hoop, partially encompass the hoop.

5. The net holder according to claim 1, wherein the insert ring consists of a resilient material.

6. The net holder according to claim 5, wherein the resilient material is selected from the group consisting of aluminum, a fiber-reinforced plastic, and steel.

7. The net holder according to claim 1, wherein the insert ring comprises an annular circular or an annular oval cross section.

8. The net holder according to claim 1, wherein the hoop comprises a C-shaped cross section and the net is arranged on hooks on the insert ring and wherein the net is additionally clamped when the hoop and the insert ring are braced.

9. The net holder according to claim 1, wherein the angle of the two opposite pins with respect to the plane of the insert ring is about 90°.

10. The net holder according to claim 1, wherein the tappet can be displaced longitudinally in a bushing connected to one of the pins and/or a rod portion and which can be moved out of the blocking function against the force of a spring to enable the clamping connection between the hoop and the insert ring and to make it possible to reduce a diameter of the insert ring.

11. The net holder according to claim 10, wherein the bushing is configured so that the tappet is guided past the crosspiece.

12. The net holder according to claim 1, wherein the tappet is double-angled at one end, wherein a last angled portion engages in an opening of the crosspiece when the releasable bearing is blocked.

13. A device for mounting a net holder according to claim 1, which comprises:

a rod;

a gear mechanism located at an end of rod; and a Bowden cable for actuating the gear mechanism, which releases the tappet from a blocking position and realizes a movement of the two opposite pins towards one another.

14. The device according to claim 13, wherein when the gear mechanism is placed on the two opposite pins, and the gear mechanism displaces the tappet such that the releasable bearing is unblocked.

15. The device according to claim 13, wherein the gear mechanism comprises a guide rail on which receptacles (18) for the two opposite pins can be displaced in a spring-loaded manner, deflection rollers for the Bowden cables are arranged centrally in relation to the guide rail and the Bowden cables are guided to a ratchet at the end of the rod.

* * * * *